United States Patent [19]

Ross

[11] Patent Number: 4,836,488

[45] Date of Patent: Jun. 6, 1989

[54] COASTER WITH ADJUSTABLE MEANS FOR RETAINING A BEVERAGE CONTAINER

[76] Inventor: Gary Ross, 140 Oxnard Ave., Oxnard, Calif. 93035

[21] Appl. No.: 194,107

[22] Filed: May 16, 1988

[51] Int. Cl.[4] ..... A47B 91/00; A47G 23/02

[52] U.S. Cl. ..... 248/346.1; 248/154

[58] Field of Search ..... 248/346.1, 154, 505, 248/510, 499, 146, 313, 310; 211/85; 220/85 R; 124/42.45 P

[56] References Cited

U.S. PATENT DOCUMENTS

| | | | |
|---|---|---|---|
| 2,784,577 | 3/1957 | Beaham | 248/346.1 UX |
| 2,893,163 | 7/1959 | Hazel | 248/346.1 |
| 3,211,404 | 10/1965 | Edmiston | 248/154 |
| 3,808,084 | 4/1974 | Doty | 248/346.1 |
| 4,040,549 | 8/1977 | Sadler | 248/346.1 X |
| 4,089,498 | 5/1978 | Woodruff | 248/346.1 |
| 4,137,356 | 1/1979 | Shoemaker | 248/346.1 X |
| 4,223,859 | 9/1980 | Erickson | 248/154 |

*Primary Examiner*—J. Franklin Foss

*Attorney, Agent, or Firm*—Thomas I. Rozsa

[57] ABSTRACT

An adjustable attachable coaster that snaps on any beverage can, disposable coffee cup, and all sizes of soft drink cups. The coaster gives the beverage container a wide base with a no-slip bottom when attached. It is designed to sit on any surface including dashboards, passenger seats, car consoles, stuffed chairs, sofas, beds, waterbeds, picnic grass, and all boat deck surfaces. The user merely takes this coaster out of the glove box or other convenient storage area, sets it down on any surface, and then places the can, plasticware or disposable cup in the middle of the coaster and snaps the hook on the upper edge of the container. The hook is attached to an elastic shock cord. There is a downward pressure from the elastic shock cord and the bottom of the container is "locked" in the recess or other transverse surface below. The beverage container now becomes one with the no-slip base. The no-slip material on the bottom of the coaster simply works by the friction of the textured material that allows it to stick to most surfaces to a forty (40) degree tilt. The beverage with the attached coaster now has a very wide base with a lowered center of gravity. It is very difficult to knock it over and therefore the container is able to withstand sudden forces imparted to it, such as the shock of a sudden stop of the car or other vehicle. The user drinks with the coaster attached.

12 Claims, 1 Drawing Sheet

COASTER WITH ADJUSTABLE MEANS FOR RETAINING A BEVERAGE CONTAINER

BACKGROUND OF THE INVENTION

1. Field of the Invention

The present invention relates to apparatus for holding and retaining beverage containers which are filled with beverages, in a manner which will assure that the beverage container will not tip over and spill the liquid contained therein. The field of the invention relates to coasters on which beverage containers are placed so as to avoid marring the surface underneath and further relates to a stabilizing and securing device which assures that the container will remain in a position which will prevent the liquid therein from being spilled. The field further relates to apparatus which are used to retain a beverage container in a moving vehicle such as an automobile.

2. Description of the Prior Art

In general, coasters are well known in the prior art and consist principally of a disc shaped object with a generally flat surface on which the beverage container is placed. While the conventional coaster provides a means by which the beverage container is separated from the underlying surface (such as a table) so that the surface will not be marred, the conventional coaster contains no means for preventing the beverage container from being tipped over when subjected to a sudden impact. This presents a particular problem in moving vehicles when a sudden stop or other force may often be imparted to a beverage container placed on a surface inside the vehicle.

Since the advent of the drive-through, 7-11's and other mini-markets, and quickened lifestyles, people have begun to enjoy beverages in their car. People frequently drink a cup of coffee while driving to work each morning and often purchase a cold drink at a convenience store when driving during a hot day. In the past, balancing the beverage container in the vehicle has proven to be a problem, especially when the liquid inside is hot, such as coffee. Some prior art methods include balancing the beverage container between one's legs, or on the adjacent seat with the bag containing the beverage container propped up against the rear of the seat.

One innovation which attempted to solve this problem is plastic holders that attach to some car doors or fit over the center consoles of a car. These holders contain a central hole through which the beverage container is placed and thereby supported. One problem with this prior art apparatus is that a given hole does not fit all sizes of containers. For example, most holes are designed to fit a conventional can and are not designed to accommodate the large paper or styrofoam cups which may container 16 or 32 fluid ounces of beverage. In addition, the accessories give a "cheap" appearance and most people prefer not adding these cheap accessories to their car. One improvement on some new vehicles is to add a molded plastic beverage holder in the door or center console. Once again, these container openings which are usually only of one size diameter and designed to accommodate a can, but not designed to accommodate various types of beverage containers, especially larger (16 or 32 fluid ounce) ounces. Another problem with all of these prior art types of holders is that it does not provide flexibility for locating the beverage container. The user is required to place the beverage container where the holder is located, which may not be at a convenient or preferred location for the user.

Therefore, there is a significant need for an apparatus which can hold a beverage container in a stable fashion, and in particular hold it in this manner in a moving vehicle.

SUMMARY OF THE PRESENT NVENTION

The present invention is a novel apparatus for providing a flat surface on which a beverage container may be placed and which further includes a flexible retaining means by which the beverage container may be retained in a stable position while in a moving vehicle and even after a force has been imparted to the container and/or the apparatus.

It has been discovered, according to the present invention, that an apparatus which includes a platform comprising multiple recessed areas combined with an elastic retaining means which further includes a hook or container clamping means provides a stable supporting apparatus which permits the beverage container to be supported on one of the recessed areas and retained in a fixed position relative to the platform by the elastic retaining means and its clamping means.

It has been further discovered, according to the present invention, that if a platform is generally of circular configuration and includes on its top at least one recessed area, a beverage container may be placed into the recessed area. If the upper surface further includes an elastic retaining means which further comprises a movable clamping means, the elastic retaining means can be flexibly stretched to accommodate the height of the specific beverage container and the clamping means can be used to clamp onto a portion of the upper surface of the beverage container, which through the downward force exerted by the elastic retaining means will enable the beverage container to remain in a fixed position relative to the platform and cause the beverage container to be securely anchored within the recess in the platform.

It has also been discovered, according to the present invention, that if the bottom of the platform comprises at least one non-slip surface for a portion of its thickness, then the platform can be more securely (but movably) anchored to a surface which will assist in providing a stable and secure platform even after a force has been imparted to the platform.

It has further been discovered, according to the present invention, that if the bottom of the platform comprises one non-slip surface adjacent its outermost portion and a second non-slip surface adjacent its innermost portion, the combined effect of the two non-slip surfaces serves to enhance the stability of the platform and further enables it to remain in its position even after a force has been imparted to the platform or to the container resting and supported on the platform.

It is therefore an object of the present invention to provide an apparatus which will securely retain a beverage container so that the container will remain in a sufficiently erect position to prevent the contents from spilling out of the container after a force has been imparted to the container.

It is another object of the present invention to provide an apparatus which will safely and securely retain a beverage container in a moving vehicle so that a user may drink from the container when he desires to do so and can safely place the container down on any generally flat surface of the vehicle (including but not limited to a car seat, center console, and dash board) when not drinking from the container.

It is a further object of the present invention to provide an apparatus which can be inexpensively made with a minimum of moving parts which at the same time efficiently retains a container in a generally fixed relationship relative to the base of the apparatus while at the same time providing means by which the container may be easily removed from the apparatus and the apparatus fitted with another container or easily stored in a small area.

It is an additional object of the present invention to provide an apparatus which can be securely placed on a surface to assure that it will not move when a force is imparted to the object while at the same time being easily picked up from the surface by the user when the user desires to drink from the beverage container being retained by the apparatus.

Further novel features and other objects of the present invention will become apparent from the following detailed description, discussion and the appended claims, taken in conjunction with the drawings.

DRAWING SUMMARY

Referring particularly to the drawings for the purpose of illustration only and not limitation, there is illustrated:

FIG. 5*a* is a side elevational view of the preferred embodiment of the clamping apparatus used in conjunction with the flexible retaining means of the present invention container retaining apparatus.

FIG. 5*b* is a side elevational view of one alternative embodiment of the clamping apparatus used in conjunction with the flexible retaining means of the present invention container retaining apparatus.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Figure 1:
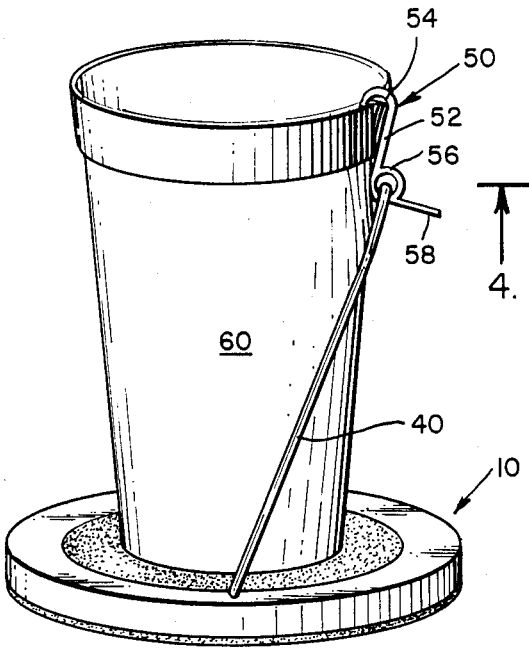
FIG. 1 is a perspective view of the present invention container retaining apparatus with a container being retained on the apparatus.
Figure 2:
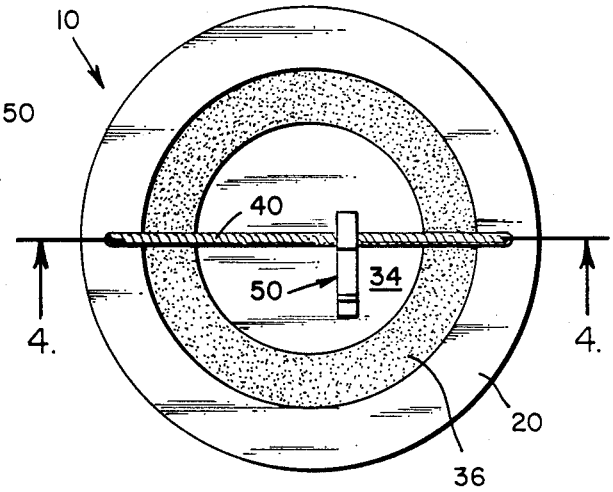
FIG. 2 is a top plan view of the present invention container retaining apparatus.
Figure 3:
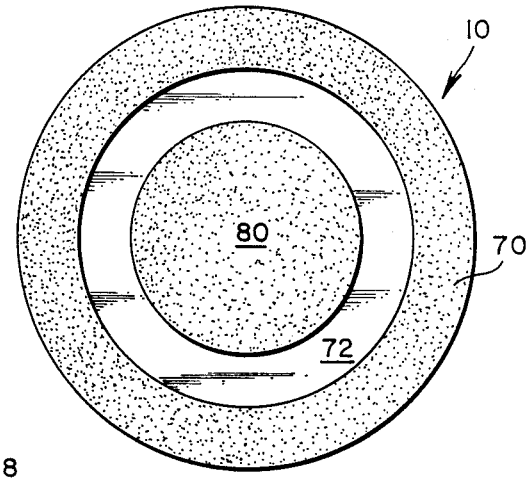
FIG. 3 is a bottom plan view of the present invention container retaining apparatus.
Figure 4:
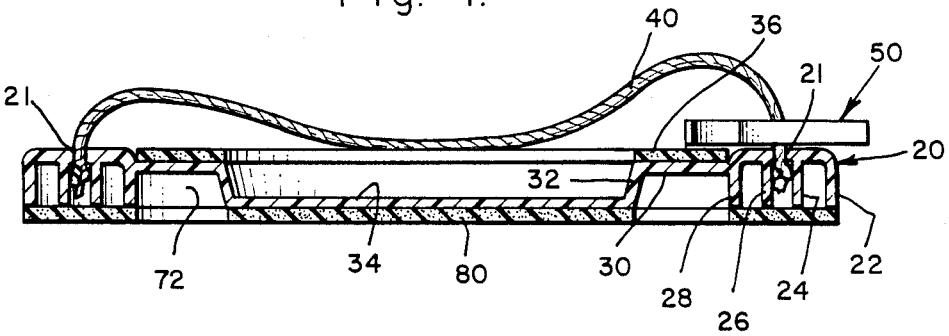
FIG. 4 is a cross-sectional view taken along line 4—4 of FIG. 2.

Referring particularly to FIGS. 1 and 4, the present invention container retaining apparatus is shown at 10. The container retaining apparatus 10 is a platform which is comprised of several sections. The platform is illustrated as being generally circular as this configuration provides a simple stable base. However, it is emphasized that platforms of other shapes, for example, square, rectangular, oval, hexagonal, and octagonal are certainly within the spirit and scope of the present invention. The platform has an outermost section 20 which provides a stabilizing portion to the platform. The outermost section 20 includes a multiplicity of downwardly extending fingers which serve to add to the stability of the section and provide a surface onto which a non-slip member can be attached. In the illustration in FIG. 4, the outermost section 20 includes four downward protrusions or fingers, 22, 24, 26 and 28. Immediately beneath the lowermost end of the fingers 22, 24, 26 and 28 is a closing surface 70 (see FIG. 3) which covers the lower end of the fingers. The surface 70 is preferably made of "non-slip" type material so that the entire apparatus 10 will not slip or move when placed on a surface.

Extending radially inward from outermost section 20 is first platform section 30 which may be (but does not have to be) recessed below outer section 20. First platform section 30 is adjacent outermost stabilizing section 20 and is connected to the inner sidewall of innermost finger 28. The innermost end of first platform section 30 is connected to a transverse wall 32 which extends downwardly to form a recessed area. The lowermost end of transverse wall 32 extends into second platform section 34 which is recessed below first platform section 30. Therefore, the design of the container retaining apparatus includes an outermost stabilizing section 20, a first recessed platform 30 disposed radially inwardly of the outermost stabilizing section and a second recessed platform 34 disposed radially inward of and below the first recessed platform 30. The transverse wall 32, which as illustrated in FIG. 4 is angularly disposed relative to both platforms 30 and 34 but also may be generally perpendicular to both platforms, serves to provide a stabilizing outside wall surrounding second or innermost recessed platform 34. As a result, second recessed platform 34 does not need any special type of adhesive or non-slip surface since the lowermost portion of the container is supported on second recessed platform 34 by transverse wall 32. First or outer recessed platform 30 does not have any stabilizing wall and therefore, in the preferred embodiment, the first recessed platform 30 is covered with a non-slip surface 36. In this way, when a container whose diameter is larger than the outermost diameter of the second recessed area 34 is placed on the platform of the container retaining apparatus 10, the outside circumference of the container will rest on the non-slip surface 36 of first recessed platform 30.

In addition to the lower surface 70 (preferably made of non-slip material) covering the fingers of outermost stabilizing section 20, the lower surface of second recessed area 34 is also preferably covered with a surface 80 made of non-slip material which further serves to enhance the stability of the container retaining apparatus 10. An open area 72 separates surface 70 from surface 80. In the preferred embodiment, the surface 80 is in the same horizontal plane as surface 70 to enhance the effect. It is also possible to have the surface 80 slightly higher than the surface 70 so that the apparatus 10 can be placed on a wider horizontal surface and be supported by surface 70 or placed on a smaller diameter surface and be supported by surface 80. However, the double enhanced effect of having the two nonslip surfaces in the same plane is a significant advantage to enhancing the overall stability of the container retaining apparatus 10.

Outermost stabilizing section 20 also comprises a pair of oppositely disposed openings 21 to provide a method for securing the elastic retaining means 40. In the preferred embodiment, the elastic retaining means 40 is a stretchable elastic cord which is commercially known as a "shock cord" or a "bungie cord". By way of example, the thickness of the cord may be one-eighth ($\frac{1}{8}$) inch thick, high stretch variety with a covering of polypropalene or nylon. The cord can be made in any color or multiplicity of colors, for attractive purposes. In its simple form, the elastic retaining means or cord 40 can be fitted through openings 21 and tied with a knot to secure the cord within the outermost stabilizing section 20. Other means such as a cross-pin or a fastener are certainly within the spirit and scope of the present invention to permit the elastic retaining means 40 to be securely fastened to the outermost stabilizing section 20. The elastic retaining means 40 is designed to be able to be stretched high enough to accommodate the height of the largest containers for which the container retaining apparatus 10 is intended to provide support. By way of example, the elastic retaining means can be of sufficient length to support a styrofoam or paper container which is 12 inches high. On the other end, it must also be sufficiently short to support the shortest container for which the container retaining apparatus 10 is intended. A conventional aluminum can may be four and three quarters ($4\frac{3}{4}$) inches high and therefor the elastic cord must not stretch to a lowermost height longer than this.

Figure 5:
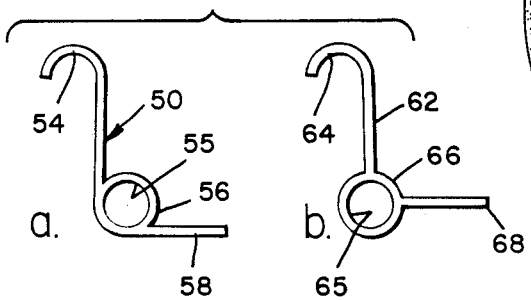

Supported along the elastic retaining means 40 is a clamping means 50 by which the elastic retaining means 40 is attached to the beverage container to be retained in such a manner that the beverage container remains fixed relative to the platform portion of the container retaining apparatus 10. In its simplest form, the retaining means is a hook 50 which comprises a hook attaching means 56 which includes opening 55 by which the hook 50 is threaded onto the elastic retaining means 40 so that the hook 50 can slide along the length of the elastic retaining means 40. The hook 50 also contains an elongated portion 52 and a curved portion 54 at one end by which the hook is attached to the edge of the beverage container 60. An optional feature is a transverse portion 58 extending outwardly of the hook 50 when it has been attached to a beverage container. This transverse portion 58 is "finger release means" by which the hook can be easily removed from the beverage container. A finger can exert an upward force on the transverse portion 58 to lift it up and cause the curved portion 54 to be removed from the edge of the container 60. The preferred embodiment of the clamping means 50 is shown in greater detail in FIG. 5 a. An alternative embodiment, with a hook attaching means 66 including opening 65, elongated portion 62, curved portion 64 and transverse finger release means 68 is shown in FIG. 5*b*. It will be appreciated that any configuration of a clamping means can work with the present invention so along as it contains at least a means by which the clamping means can be slidably attached to the elastic retaining means 40 and a means by which it can be attached to or "clamped onto" a portion (preferably to the top) of the container 60 to be retained by the container retaining means 10.

The apparatus 10 in use is shown in FIG. 1. A container 60 which by way of example can be a beverage container such as a styrofoam or paper cup in which sodas are conventionally sold is placed so that its base rests on the surface 34 of interior second recessed section 34 and so that the lowermost portion of the container's base is supported by interior transverse wall 32. It will be appreciated that if the container 60 had a wider base whose diameter was greater than the outer diameter of second interior section 32, then it could rest on first recessed section 30 and preferably on a non-slip surface 36 covering the first recessed section 30. The clamping means 50 is slid along the flexible retaining means 40 until it is at the highest point between the two lowermost ends supported in holes 21. The clamping means and elastic retaining means 40 is stretched so that the curved portion 54 of clamping means 50 fits over the top edge of the beverage container 60 so that the clamping means 50 and elastic retaining means 40 provide a downward force to thereby cause the container 60 to remain securely on the section (34 or 30/32) on which it has been placed. It will be appreciated that cup, cups with plastic lids, cans, and other conventional beverage containers may be retained in this manner.

Described in its broadest form, the present invention is an apparatus for retaining a container comprising: (a) a platform comprising at least one recessed area; (b) a flexible retaining means retained on said platform; and (c) a movable clamping means movable attached to said flexible retaining means; (d) whereby said container is placed on said platform so that the lowermost portion of the container rests within said at least one recessed area of the platform and said flexible retaining means is stretched so that said clamping means is attached to a portion of the container to thereby lock the container onto said platform.

In its broadest form, the present invention is an adjustable attachable coaster that snaps on any beverage can, disposable coffee cup, and all sizes of soft drink cups. The coaster gives the beverage container a wide base with a no-slip bottom when attached. It is designed to sit on any surface including dashboards, passenger seats, car consoles, stuffed chairs, sofas, beds, waterbeds, picnic grass, and all boat deck surfaces. It has been experimentally proven that the container retaining apparatus 10 as described can support a container in a non-spill manner at angles up to forty (40) degrees to the horizontal. The user merely takes this coaster out of the glove box or other convenient storage area, sets it down on any surface, and then places the can, plasticware or disposable cup in the middle of the coaster and snaps the hook on the upper edge of the container. There is a downward pressure from the elastic shock cord and the bottom of the container is "locked" in the recess or other transverse surface below. The beverage container now becomes one with the no-slip base. The no-slip material on the bottom of the coaster simply works by the friction of the textured material that allows it to stick to most surfaces to a forty (40) degree tilt. The beverage with the attached coaster now has a very wide base with a lowered center of gravity. It is very difficult to knock it over and therefore the container is able to withstand sudden forces imparted to it, such as the shock of a sudden stop of the car or other vehicle. The user drinks with the coaster attached. Through use of the present invention, the user can even put a large "big gulp" container filled with liquid down on the passenger seat, console, or dash without the fear of it falling over.

By way of example, the core of the platform consisting of the outermost stabilizing section 20 (and its related fingers), the first platform section 30, transverse wall 32 and interior second recessed platform section 30 can be of one piece construction and may be an injection molded plastic part. The best priced domestic plastic that is suitable is polypropalene. The non-slip material covering the first interior section 30 and the lower surface beneath the outermost stabilizing section 20 and second recessed section 34 can be made of rubber. The elastic retaining means or stretchable elastic cord 40 may be ⅛ inch thick elastic with a covering of polypropalene or nylon. The clamping means or hook 50 can be made in a variety of ways and configurations, two of which are illustrated in FIGS. 5*a* and 5*b*. In one embodiment, the hook 50 can be sewn into a piece of nylon webbing which is threaded through the cord. The preferred embodiment is as illustrated with the hook containing a means such as a loop for enabling the hook to slide along the length of the cord. The hook 50 can be made of any suitable material such as plastic, metal, or wood.

By way of example, the diameter of the base portion of apparatus 10 can be approximately five and three eights (5⅜) inches, the outer diameter of the first retaining section 30 can be three and seven-eights (3⅞) inches and the outer diameter of the second interior section 34 can be approximately two and one-quarter (2¼) inches. The elastic retaining means 40 in its unstretched position can extend to a height of approximately two and one-half (2½) inches above the base. The clamping means 50 can be approximately one (1) inch long. The height of the outermost section 20 can be approximately three-eights (⅜) of an inch. In the preferred embodiment, the openings 21 are 180 degrees apart, although openings offset from the center and closer together are also within the spirit and scope of the present invention.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention or the scope of patent monopoly to be granted.

What is claimed is:

1. An apparatus for retaining a beverage container comprising:

a. a platform comprising at least one recessed area which can accommodate the lower surface of a beverage container of any desired shape and size;

b. a single flexible retaining means retained on said platform; and c. a single movable clamping means movably attached to said single flexible retaining means to engage the upper surface of said beverage container in a manner wherein a single movable clamping means and a single retaining means creating a downward pressure on the beverage container from a single point of attachment on the beverage container retains said beverage container on said platform;

d. whereby said beverage container is placed on said platform so that lowermost portion of the beverage container rests within said at least one recessed area of the platform and said single flexible retaining means is stretched so that said single movable clamping means is attached to a portion of the upper surface of said container to thereby lock the beverage container onto said platform, wherein said single flexible retaining means is retained on two oppositely disposed locations of said platform.

2. The apparatus in accordance with claim 1 wherein said platform is made of plastic.

3. The apparatus in accordance with claim 1 wherein said single flexible retaining means is an elastic cord.

4. The apparatus in accordance with claim 1 wherein said single movable clamping member is a hook.

5. An apparatus for retaining a beverage container comprising:

a. a generally circular coaster member further comprising an outermost stabilizing section, a first platform section extending radially inward from the outermost stabilizing section and a second centrally disposed platform section extending radially inward from and recessed below the first platform section wherein the two platform sections can accommodate the lower surface of a beverage container of any desired shape and size;

b. a single flexible retaining means retained on said platform; and c. a single movable clamping means movably attached to said single flexible retaining means to engage the upper surface of said beverage container in a manner wherein a single movable clamping means and single retaining means creating a downward pressure on the beverage container from a single point of attachment on the beverage container retains said beverage container on said generally circular coaster;

d. whereby said beverage container is placed on said generally circular coaster so that the lowermost portion of the beverage container rests either on said first platform section or on said second platform section and said single flexible retaining means is stretched so that said single movable clamping means is attached to a portion of the upper surface of said beverage container to thereby lock the beverage container onto said generally circular coaster, wherein said single flexible retaining means is retained on two oppositely disposed locations of said outermost stabilizing section.

6. The apparatus in accordance with claim 5 wherein the top of said first platform section further comprises a surface of non-slip material attached thereto.

7. The apparatus in accordance with claim 5 wherein the bottom of said second platform section further comprises a surface of non-slip material attached thereto.

8. The apparatus in accordance with claim 5 wherein said outermost stabilizing section is hollow and further comprises a multiplicity of downwardly extending fingers within it which support a non-slip surface attached to their lowermost extremity.

9. The apparatus in accordance with claim 5 wherein:

a. the bottom of said second platform section further comprises a surface of non-slip material attached thereto;

b. said outermost stabilizing section is hollow and further comprises a multiplicity of downwardly extending fingers within it which support a nonslip surface attached to their lowermost extremity; and c. the non-slip surface attached to the bottom of said second platform section and the non-slip surface attached to said fingers within said outermost stabilizing section lie in the same horizontal plain.

10. The apparatus in accordance with claim 5 wherein said coaster is made of plastic.

11. The apparatus in accordance with claim 5 wherein said single flexible retaining means is an elastic cord.

12. The apparatus in accordance with claim 5 wherein said single movable clamping member is a hook.

* * * * *